US009908029B2

(12) United States Patent
Linzmeier

(10) Patent No.: US 9,908,029 B2
(45) Date of Patent: Mar. 6, 2018

(54) SPORTING DEVICE

(71) Applicant: Horst Linzmeier, Insel Reichenau (DE)

(72) Inventor: Horst Linzmeier, Insel Reichenau (DE)

( * ) Notice: Subject to any disclaimer, the term of this patent is extended or adjusted under 35 U.S.C. 154(b) by 24 days.

(21) Appl. No.: 15/116,065

(22) PCT Filed: Feb. 5, 2015

(86) PCT No.: PCT/EP2015/000229

§ 371 (c)(1),
(2) Date: Aug. 2, 2016

(87) PCT Pub. No.: WO2015/117756

PCT Pub. Date: Aug. 13, 2015

(65) Prior Publication Data

US 2017/0246526 A1 Aug. 31, 2017

(30) Foreign Application Priority Data

Feb. 8, 2014 (DE) ..... 10 2014 001 548
Apr. 12, 2014 (DE) ..... 20 2014 003 170 U

(51) Int. Cl.
*A63C 5/075* (2006.01)
*A63C 9/00* (2012.01)

(52) U.S. Cl.
CPC ..... *A63C 5/075* (2013.01); *A63C 9/003* (2013.01); *A63C 2203/20* (2013.01); *A63C 2203/46* (2013.01)

(58) Field of Classification Search
CPC ..... A63C 5/075; A63C 9/003; A63C 1/24; A63C 1/28; A63C 2203/20; A63C 2203/46; A63C 2203/54
See application file for complete search history.

(56) References Cited

U.S. PATENT DOCUMENTS 70,906 A * 11/1867 Shearer ..... A63C 1/24
280/11.14
1,702,316 A * 2/1929 Ridgers ..... A63C 1/36
280/11.14

(Continued)

FOREIGN PATENT DOCUMENTS

DE 3712807 A1 * 11/1988 ..... A63C 5/00
DE 102004048946 4/2006

(Continued)

*Primary Examiner* — James A Shriver, II
*Assistant Examiner* — Steve Clemmons
(74) *Attorney, Agent, or Firm* — Volpe and Koenig, P.C.

(57) ABSTRACT

The invention relates to a sports item (1), comprising a carrier (3) for a coupling device (25) for accommodating a user and including at least one distributing device (2) for the loads and/or forces to be transmitted to the sports item (1), which at least one distributing device (2) connects the carrier (3) to the sports item (1) via a joint arrangement, the latter having at least one pivoting arm (4, 5; 6, 7), which is pivotably connected, in each case via a joint (8, 9; 10, 11), to the sports item (1) at one arm end of the pivoting arm and to the carrier (3) at the other arm end of the pivoting arm, wherein the carrier (3) is movable from a starting position, counter to the restoring force of at least one elastic restoring element, to a balancing position in which the carrier is brought closer to the sports item (1). The sports item (1) according to the invention is characterized in that the at least one restoring element is an elastically deformable spring element (12; 13), which is held at one end on the carrier (3) and at the other end on the sports item (1).

27 Claims, 11 Drawing Sheets

(56) References Cited

U.S. PATENT DOCUMENTS

| | | | | |
|---|---|---|---|---|
| 4,139,214 | A | 2/1979 | Meyer | |
| 4,848,781 | A * | 7/1989 | Dykema | A63C 5/03 280/14.21 |
| 4,993,725 | A * | 2/1991 | Barnes | A63C 1/24 280/11.14 |
| 5,127,672 | A * | 7/1992 | Horibata | A63C 11/22 280/11.14 |
| 5,540,458 | A | 7/1996 | Arduin et al. | |
| 5,931,480 | A * | 8/1999 | Schroeder | A63C 1/28 280/11.211 |
| 7,237,784 | B1 * | 7/2007 | Monteleone | A63C 17/01 280/87.03 |
| 2002/0096860 | A1 * | 7/2002 | Lowe | A63C 5/07 280/602 |
| 2013/0106068 | A1 * | 5/2013 | Franko | A63C 5/02 280/11.15 |

FOREIGN PATENT DOCUMENTS

| | | | | |
|---|---|---|---|---|
| DE | 202009000947 | U1 * | 4/2009 | A63C 5/075 |
| EP | 0182776 | | 5/1986 | |
| EP | 0230989 | | 8/1987 | |
| EP | 0612546 | A2 * | 8/1994 | A63C 10/14 |
| EP | 0658360 | | 6/1995 | |
| EP | 0692284 | | 1/1996 | |
| FR | 1526418 | | 5/1968 | |
| FR | 2338720 | | 1/1977 | |
| FR | 2439030 | A1 * | 5/1980 | A63C 17/18 |
| FR | 2768937 | | 4/1999 | |
| JP | 2010094294 | | 4/2010 | |
| WO | WO-0211829 | A2 * | 2/2002 | A63C 5/075 |
| WO | WO-2009099346 | A2 * | 8/2009 | A63C 5/07 |
| WO | 2009123576 | | 10/2009 | |
| WO | WO-2013006874 | A1 * | 1/2013 | A63C 5/075 |
| WO | WO-2015105435 | A1 * | 7/2015 | A63C 5/075 |
| WO | WO-2015150217 | A1 * | 10/2015 | A63C 5/075 |

* cited by examiner

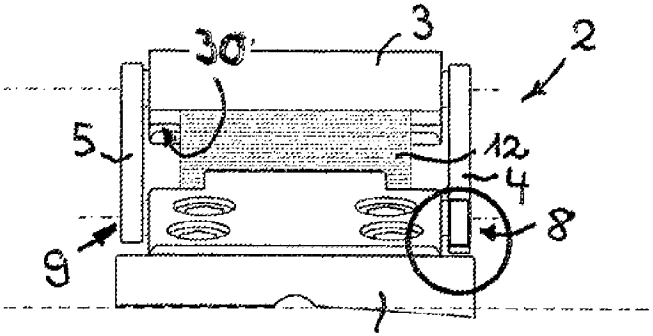
Fig. 4
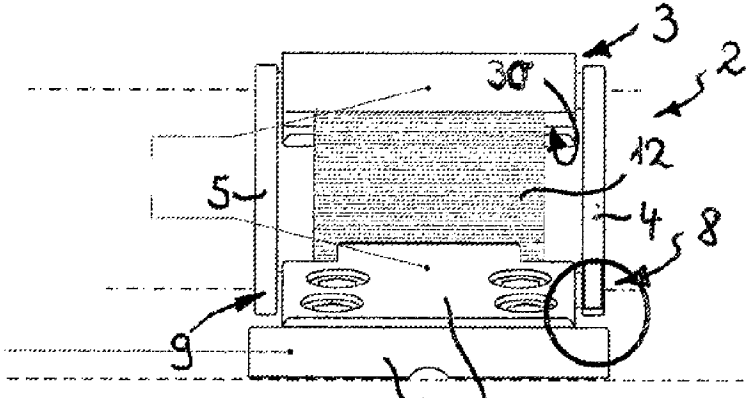
Fig. 2
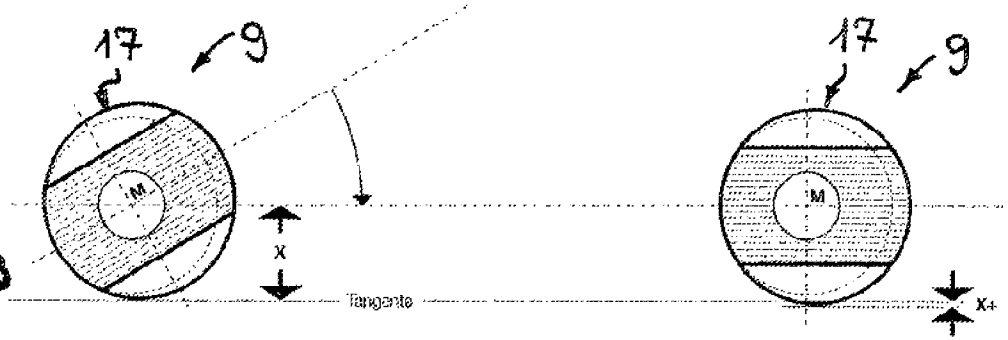
Fig. 3
Fig. 5

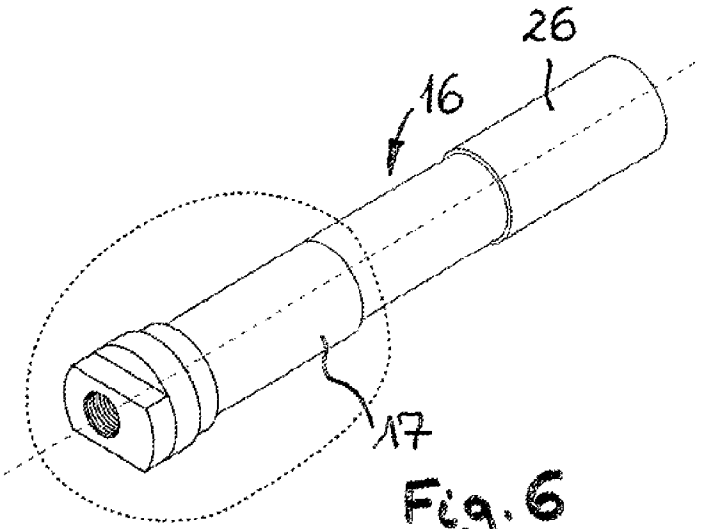
Fig. 6
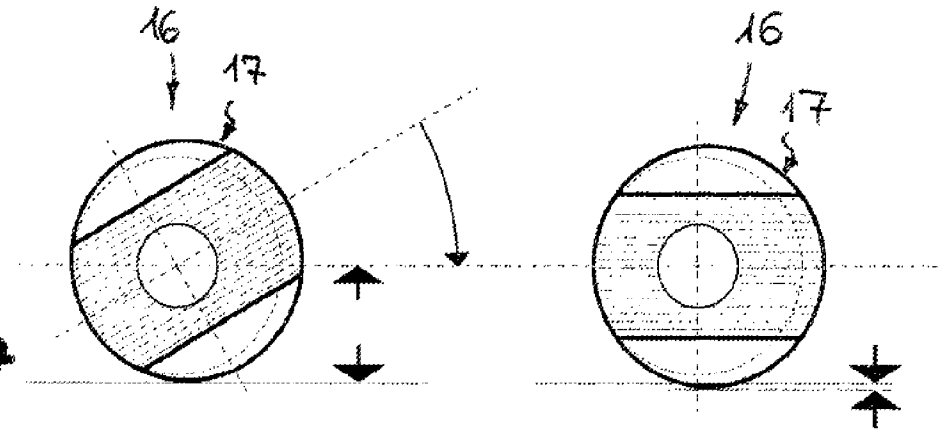
Fig. 7
Fig. 8

SPORTING DEVICE

The invention relates to a sporting device (or item), comprising a carrier for a coupling device for accommodating a user and comprising at least one distributing device for the loads and/or forces to be transmitted to the sports item, which at least one distributing device connects the carrier to the sports item via a joint arrangement, the latter having at least two pivoting arms, which are oriented in the longitudinal direction of the sports item and are spaced laterally apart from each other, wherein the pivoting arms are pivotably mounted on both sides, in each case via a pivot axle serving as a joint, with their one arm end on a holder held on the sports item and with their other arm end on the carrier, wherein the carrier is movable from a starting position, counter to the restoring force of at least one elastic restoring element, to a balancing position in which the carrier is brought closer to the sports item, which at least one restoring element is an elastically deformable spring element or damping element which is held at one end on the carrier and at the other end on the sports item, and wherein the pivoting arms arranged on both sides of the holder and on the carrier are connected to the holder and on the carrier via a common plug-in axle.

A sports item designed as a ski and of the aforementioned type is already known from EP 0 230 989 B1, which sports item is designed with a distributing device for the loads or forces to be transmitted to the sports item. The distributing device of the previously known sports item has a carrier on which a ski binding or similar coupling device is provided for accommodating the user. The carrier is connected to the sports item via a joint arrangement of the distributing device, which joint arrangement has two pivoting arms which are spaced apart from each other in the longitudinal direction of the ski and which are pivotably connected, in each case via a joint, to the sports item at one arm end of the pivoting arm and to the carrier at the other arm end of the pivoting arm. The carrier is in this case supported with respect to the ski board of the ski by a torsion bar spring arranged more or less centrally between the pivoting arms, in such a way that the carrier is movable from a starting position, counter to the restoring force of the torsion bar spring, to a balancing position in which the carrier is brought closer to the sports item. In order to improve the guide properties and the directional stability even in tight winding maneuvers and to improve drift when skiing at an angle down steep slopes, the pivoting arms which support the carrier at its front end and rear end, and which are guided in bearing elements arranged on the ski surface, are connected to the ski such that, through the rotation of the pivoting arms about their joint axes, the carrier describes a superposed vertical and horizontal movement to the ski surface, wherein the carrier is supported resiliently with respect to the ski by means of the torsion bar spring, at least at one point between the articulated bindings of the front end and rear end. However, the distributing device of the previously known sports item is in many parts, is associated with a not inconsiderable additional weight and is high, which can annul the advantages of this distributing device for the user.

EP 0 182 776 A2 already discloses a ski on which a support plate intended to receive the ski binding is attached to the ski in an articulated manner about a rear hinge pin. To be able to improve the load distribution along the length of the ski, vary the guide properties and damping properties and, for this purpose, adjust the flexibility of the ski, the support plate, in its front area, is supported slidingly on a bearing relative to the ski. In this way, the flexibility values can be defined in a standard way such that the ski is initially clamped at the middle and the bending of the ski close to the tip area and close to the rear area is measured depending on the load in these areas, and such that a second measurement is then carried out in which the ski is clamped at a distance of about one third from the rear end and from the tip end of the ski, wherein once again the bending is measured depending on the load at the ski end or the tip, as a result of which a relatively more exact picture of the flexibility behavior of the ski can be obtained. In FIG. 5 of EP 0 182 776 A2, a ski design is also shown in which the front end of the support plate presses against a spring element or damping element which has a round cross section and which is made of elastic material. A deflection on the ski during downhill skiing is sought with the aid of this rubber-elastic spring element or damping element.

JP 2010 094294 A already discloses a ski with a carrier plate which is provided to receive the ski binding and which, at its front end area in the direction of travel, is secured pivotably on the ski. By contrast, the rear end area of the carrier plate protrudes above the ski, wherein a spring element or damping element is arranged between the ski and the rear end area of the carrier plate. The arrangement already known from JP 2010 094294 A is intended to improve the transmission of the body weight of the skier to the ski and to positively influence the steerability of the ski.

FR 2 338 720 A1 already discloses a ski which carries a springboard which is connected to the ski via a fixed branch and which has a freely swinging branch which receives the ski binding. Between its fixed branch connected to the ski surface and the vertically offset, freely swinging branch receiving the ski binding, the springboard has an approximately semicircular shape for receiving an elastic cylinder. This previously known arrangement seeks to provide an additional spring effect and strong loading and unloading of the ski, wherein it is also sought to facilitate changes of direction. The springboard is intended to attenuate impacts and jolts, which occur particularly on hard, bumpy, icy and undulating pistes, and thereby to provide the ski with smoother running properties and thus protect the skier's bones.

FR 2 768 937 A1 has already described a ski which is connected to a carrier plate receiving the ski binding, Rubber-elastic spring elements or damping elements, provided between the ski and the carrier plate, have a cylindrical shape and are oriented with their longitudinal extent transverse to the direction of travel of the ski. In these rubber-elastic damping elements, a support plate is provided which, in terms of its alignment to the ski and to the carrier plate, can be turned such that the damping properties of these spring elements and damping elements can be additionally varied.

EP 0 658 360 A1 already discloses a ski with a ski binding, which has a carrier plate between its spaced-apart front and rear binding cheeks. Between this carrier plate and the ski, plate-shaped rubber-elastic spring elements or damping elements are provided which are intended to afford improved damping properties.

DE 10 2004 048 946 A1 already discloses a ski with a ski connection, which has at least one main frame and a connection system, wherein at least one ski binding is arranged on the main frame. The connection system itself has at least one scissors-type linkage which, with at least four coupling areas, is connected to the main frame and to the ski. This scissors-type linkage is secured to the main frame at two points and to the upper face of the ski at two points. The arrangement already known from DE 10 2004

048 946 A1 seeks to impair the bending behavior of a ski as little as possible, in particular when taking curves.

WO 2009/123576 already discloses a ski with a ski binding which is connected to the ski via a platform. This platform has a base plate which is held on the ski and on which the ski boot stands and is held between a front and a rear binding cheek. Each of these binding cheeks is provided on an associated positioning plate. At their one end area, the two positioning plates are mounted pivotably on the base plate and, with their other end area on the inside, are connected to the base plate via a joint arrangement. The joint arrangement of each positioning plate is pressed by a spring element or damping element in the direction of the skier, such that the transmission of impact-induced vibrations to the skier is reduced.

SUMMARY

The object is therefore to make available a sports item of the type mentioned at the outset with at least one distributing device which is able to substantially improve the skiing comfort and, also the guide properties of the sports item in a way that is appreciable to the user.

In the sports item of the kind mentioned at the outset, this object is achieved, according to the invention, in particular by the fact that the pivot axle of at least one joint of the joint arrangement can be varied in position by means of an eccentric.

The sports item according to the invention, which can be designed for example as a ski or also as a roller carrier, has at least one distributing device for the forces and loads to be transmitted to the sports item. This at least one distributing device connects the sports item to a carrier, which carries a ski binding or similar coupling device for accommodating the user. The carrier is connected to the sports item via a joint arrangement, the latter having at least one pivoting arm, which is pivotably connected, in each case via a joint, to the sports item at one arm end of the pivoting arm and to the carrier at the other arm end of the pivoting arm. By means of a pivoting movement of the pivoting arm, the carrier is movable from a starting position, counter to the restoring force of at least one elastic restoring element, to a balancing position in which the carrier is brought closer to the sports item. The restoring element provided is an elastically deformable spring element or damping element, which is held at one end on the carrier and at the other end on the sports item. This at least one spring element or damping element can be braced or held between the carrier and the sports item in such a way that a stable and secure connection between the carrier and the sports item is ensured even when the at least one distributing device has only one or two pivoting arms. However, such a spring element or damping element at the same time also has a sufficient elasticity to ensure that the impacts and vibrations acting on the sports item are transmitted only in attenuated form to the carrier and to the user held on the carrier. This at any rate only attenuated transmission of impacts and vibrations is felt by the user to provide substantially improved skiing comfort.

The sports item according to the invention has at least one distributing device for the loads and/or forces to be transmitted to the sports item, which distributing device has at least two pivoting arms, which are oriented in the longitudinal direction of the sports item and are laterally spaced apart from each other. These pivoting arms are pivotably mounted on both sides, in each case via a pivot axle serving as a joint, with their one arm end on a holder held on the sports item and with their other arm end on the carrier, wherein the pivoting arms arranged on both sides of the holder and on the carrier are connected to the holder and on the carrier via a common plug-in axle. By means of the at least two pivoting arms spaced laterally apart from each other, the angle position between the carrier on the one hand and the sports item on the other hand, which angle position is required in particular when taking curves or when descending steep slopes, can be guided and controlled particularly efficiently. In order to be able to change the position of the pivot axle on at least one of the joints of the joint arrangement, provision is made, according to the invention, that the pivot axle of at least one joint of the joint arrangement can be varied in position by means of an eccentric.

In a particularly simple embodiment according to the invention that can be produced at little cost, provision is made that the at least one spring element is designed as an elastically deformable tube. By virtue of its shape and the inherent elasticity of the material used, such an elastically deformable tube is able to deploy the desired spring properties and damping properties.

It may be advantageous if the at least one tube serving as a spring element is oriented with its tube longitudinal axis transverse to the longitudinal extent of the sports item.

In a preferred embodiment according to the invention that is distinguished, on the one hand, by particularly good spring properties and damping properties and, on the other hand, by stable guide properties, provision is made that the at least one spring element is designed as a resiliently flexible spring plate.

The resiliently flexible spring plate can be produced from any suitable resiliently elastic material. In an advantageous embodiment according to the invention, provision is made that the spring plate is produced from carbon. However, in a preferred development of the invention, the at least one spring plate is designed as a spring steel plate.

In order to design the at least one spring plate with sufficient stiffness and stability, on the one hand, and with satisfactory spring elasticity, on the other hand, provision is made, in an advantageous development according to the invention, that the spring plate has a flexibility defined by at least one edge-side indentation or protrusion and/or at least one plate opening.

To ensure that the distributing device provided between the carrier and the sports item can be bound safely and securely on the sports item, the at least one distributing device has a holder held on the sports item, which holder is connected to the at least one pivoting arm via the at least one joint.

To allow the resiliently flexible spring plate to be accommodated and fixed between the carrier and the holder, it is expedient if, on the carrier and on the holder of the at least one distributing device, at least one respective holding slit is provided, into which holding slits the at least one spring plate is inserted with its adjacent plate edge.

To ensure that the spring elasticity of the at least one spring plate can be utilized over the largest possible partial area of its longitudinal extent, provision is made that the at least one slit provided on the carrier widens from the slit base in the direction of the slit opening.

The assembly of the at least one spring plate and the possibly required replacement of this spring plate, for example if a modified spring force is desired, are made easier if the at least one holding slit provided on the carrier and/or on the holder is, with the exception of the slit base, open on three sides.

In order to hold the at least one spring element or damping element securely between the carrier on the one hand and the sports item on the other hand, provision is made, in a preferred embodiment according to the invention, that the pivoting arms are arranged on both sides of the at least one spring element or damping element.

If the at least one spring element or damping element is designed as a spring plate, this spring plate can in practice be pushed into the holding slits on the carrier and on the holder without the need for the spring plate subsequently to be screwed tight, if the pivoting arms arranged on both sides of the at least one spring plate secure the at least one spring plate preferably in the holding slits on the carrier and on the holder.

In a particularly advantageous embodiment according to the invention, provision is made that the pivoting arms are each mounted pivotably on the holder and on the carrier, in particular laterally, via a pivot axle serving as joint, preferably on both sides.

In a development according to the invention and deserving of independent protection, provision is made that the pivot axle of at least one joint of the joint arrangement can be varied in position in such a way that the distance between the one long side of the carrier and the sports item can be made smaller or larger compared to the distance from the other long side of the carrier, for example by an inclined position of the sports item brought about when taking a curve.

The joint arrangement in this development according to the invention has at least one joint whose pivot axle can be varied in position in such a way that the distance between the one long side of the carrier and the sports item can be made smaller or larger compared to the distance from the other long side of the carrier. Thus, by changing the position of the pivot axle of at least one of the joints of the joint arrangement, the distance of the carrier from the sports item on its one long side can be made larger or smaller compared to the distance on its other long side, in such a way that the sports item is distinguished by substantially improved directional stability in steep positions or in particular in tight curves. When taking curves, the distance of the carrier should increase on its long side located on the inside of the curve and/or additionally or instead should decrease on its long side located on the outside of the curve.

The travel behavior of the sports item according to the invention having the distributing device can also be further adapted at a subsequent stage and in accordance with individual requirements or wishes, if the plug axle having the at least one eccentric axle portion is held exchangeably on the holder and/or on the carrier.

In addition to or instead of at least one joint of variable position, provision is made, in a development according to the invention and deserving of independent protection, that at least one distributing device of the sports item is assigned at least one spacer which sets the minimum distance of the carrier from the sports item, and that the at least one spacer is designed such that, at the minimum distance of the carrier from the sports item, the distance between the one long side of the carrier and the sports item is made smaller or larger compared to the distance from the other long side of the carrier.

In order to achieve a non-tilted position between the carrier and the sports item at the minimum distance of the carrier from the sports item, at least one distributing device can be assigned at least two spacers which differ from each other in terms of different heights and/or in terms of different elasticity. However, in a simple and advantageous embodiment according to the invention, provision is made that the spacer has a rod-shaped or slat-shaped design and is oriented transversely with respect to the longitudinal extent of the sports item.

The spacer can be produced from non-elastic material, for example hard plastic or metal. However, in order to achieve smooth transitions in terms of the travel properties sought in steep positions or in tight curves, it is advantageous if the spacer is produced from elastic material.

It is possible here that the spacer has a different elasticity in different partial areas of its longitudinal extent, in such a way that, at the minimum distance of the carrier from the sports item, the distance between the one long side of the carrier and the sports item is made smaller or larger compared to the distance from the other long side of the carrier.

In addition or instead, it may be advantageous if the at least one spacer has different heights in the area of the one long side of the sports item compared to the other long side of the sports item, in such a way that, at the minimum distance of the carrier from the sports item, the distance between the one long side of the carrier and the sports item is made smaller or larger compared to the distance from the other long side of the carrier. Such an embodiment makes it possible to produce the whole spacer from the same material and in particular with an elasticity that remains the same in all partial areas.

In a particularly simple and advantageous embodiment according to the invention, provision is made that at least one spacer has an abutment face inclined with respect to a plane lying in the running surface of the sports item.

In a particularly simple embodiment according to the invention that is easy to assemble, provision is made that the at least one spacer is fixed on the sports item.

To ensure that the travel properties of the sports item according to the invention can be advantageously adapted for example in steep positions, in tight curves or in other extreme situations, it is expedient if the flexibility of the at least one spring plate is such that the distance of the carrier from the sports item decreases when taking a curve. In this embodiment, the flexibility of the spring plate is such that the distributing device allows the carrier to move closer to the sports item. In this approach movement of the carrier in the direction of the sports item, the pivoting arms of the distributing device are swiveled inward in the direction of the sports item and, if appropriate, a spacer provided in certain embodiments of the sports item according to the invention becomes active in the manner described above.

To ensure that the steering movements exerted by the user's foot can be safely transmitted via the carrier to the sports item, and to ensure that the sports item according to the invention can easily take up and distribute the loads acting on it, it is expedient if the carrier is connected to the sports item via at least two distributing devices.

In order to promote a slight tilting movement of the carrier relative to the sports item, it is advantageous if the plug-in axle is mounted in the guide openings, provided on the holder and/or on the carrier holder, via two axle segments spaced apart from each other in the longitudinal direction of the plug-in axle. In a particularly advantageous embodiment according to the invention, which facilitates the tilting movement sought in tight curves for example, provision is made that the axle segments of the plug-in axle that are mounted rotatably in the guide openings (18, 19) of holder and/or carrier holder are designed as a spherical cross-sectional thickening.

In advantageous illustrative embodiments according to the invention, provision is made that the sports item is designed as a sliding body and in particular as a ski or as a roller carrier.

BRIEF DESCRIPTION OF THE DRAWINGS

Developments according to the invention will become clear from the description of the figures in conjunction with the claims and with the drawing. The invention is described in more detail below on the basis of a preferred illustrative embodiment.

In the drawings:

FIG. 2 shows a rear view of the distributing device of the ski shown in FIG. 1, in an unloaded starting position, FIG. 3 shows the pivot axle of one of the pivoting arms of the distributing device in the area marked in FIG. 2, which pivot axle serves as one of the joints of the joint arrangement and is mounted rotatably on a holder, FIG. 4 likewise shows a rear view of the distributing device of the ski shown in FIG. 1, in an inwardly deflected balancing position as a result of the action of a force, in which position the carrier is moved closer to the ski, FIG. 5 shows the pivot axle of one of the pivoting arms of the distributing device in the area boxed in FIG. 4, which pivot axle is mounted rotatably on the holder, FIG. 6 shows a plug-in axle belonging to the distributing device and forming the joints mounted rotatably on the holder, FIG. 7 shows the plug-in axle from FIG. 6 having an eccentric axle portion, in the rotation position (shown in FIGS. 2 and 3) of the pivoting arms mounted on it, FIG. 9 shows the ski and its distributing device, in an exploded perspective view of individual component parts of the distributing device.

DETAILED DESCRIPTION OF THE PREFERRED EMBODIMENTS

Figure 1:
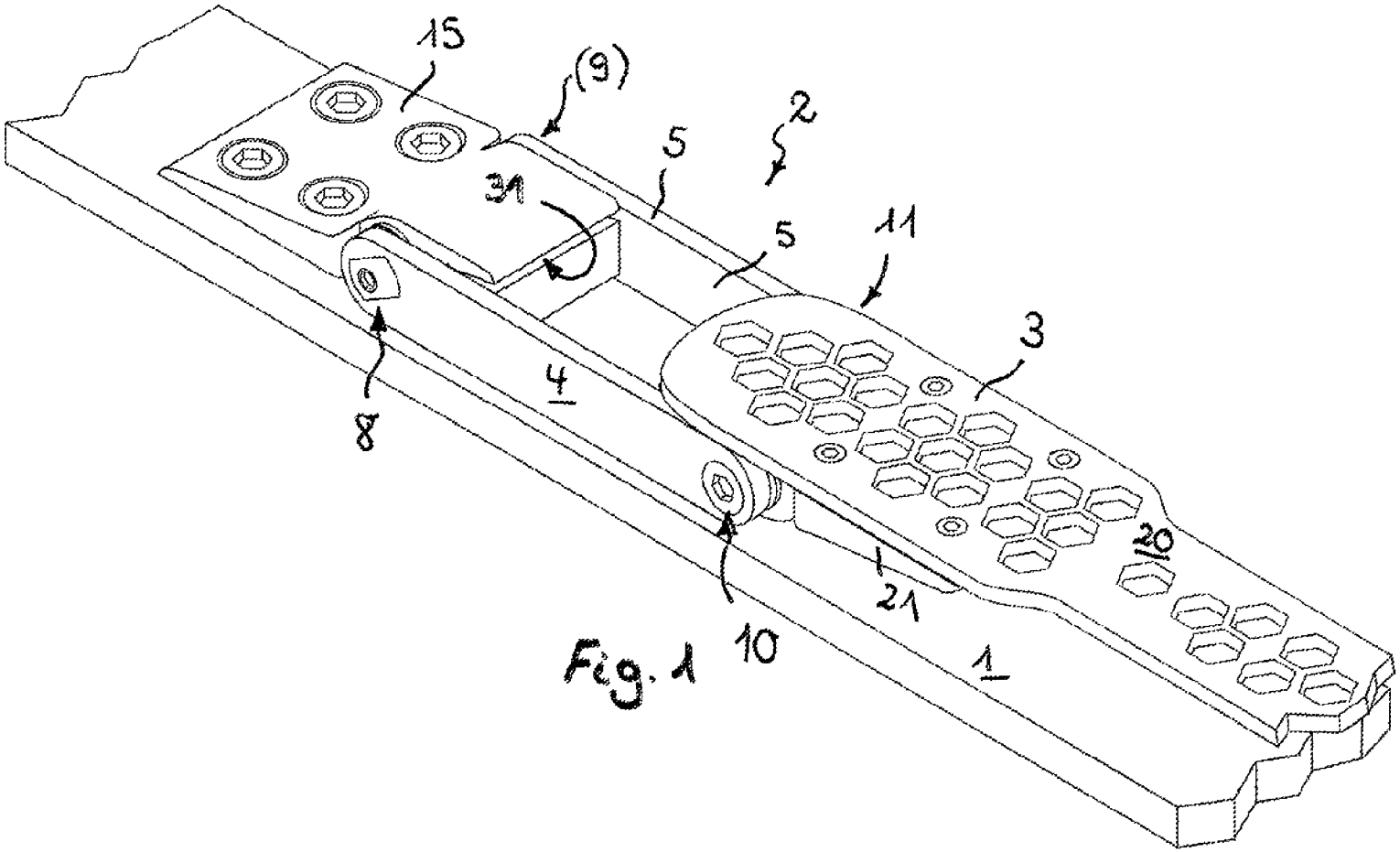
FIG. 1 shows a perspective view of the ski of a pair of skis consisting of two skis, in the area of a distributing device which has to distribute the loads and/or forces to be transmitted to the sports item, wherein the distributing device has a joint arrangement which connects the ski to a carrier for a coupling device for accommodating a user, and wherein this joint arrangement has at least two parallel pivoting arms which are pivotably connected, in each case via a joint, to the sports item at one arm end of the pivoting arm and to the carrier at the other arm end of the pivoting arm.
Figure 8:
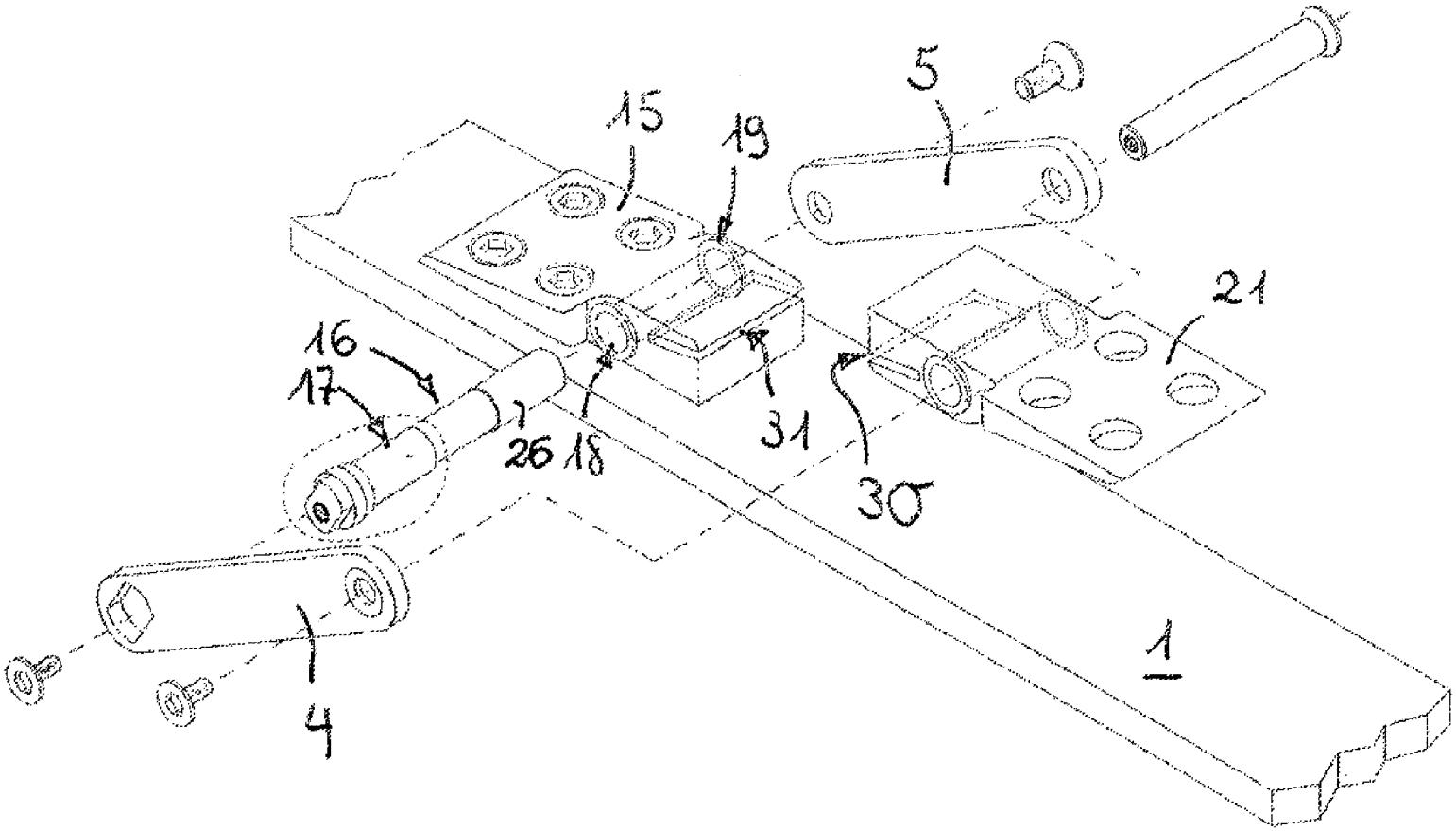
FIG. 8 shows the plug-in axle from FIGS. 6 and 7 in the rotation position of the pivoting arms as shown in FIGS. 3 and 4.

FIGS. 1, 2, 4, 9, 10, 12 to 16, 18 to 20 and 22 show various embodiments of a sports item 1, which is formed here as a ski from a pair of skis consisting of two skis. The sports item 1 has at least one distributing device 2 for the forces and loads to be transmitted to the sports item 1. This at least one distributing device 2 connects the sports item 1 to a carrier 3, which carrier carries a ski binding (indicated by broken lines in FIG. 13) or similar coupling device 25 for accommodating the user. It is clear from FIG. 12 that the carrier 3 is preferably connected to the sports item 1 via two distributing devices 2 spaced apart from each other in the longitudinal direction of the sports item 1. Each of the distributing devices 2 forms a joint arrangement which connects the carrier 3 to the sports item 1 and which has at least one pivoting arm 4, 5; 6, 7 which is pivotably connected, in each case via a joint 8, 9; 10, 11, to the sports item 1 at one arm end of the pivoting arm and to the carrier 3 at the other arm end of the pivoting arm. By means of a pivoting movement of the pivoting arms 4, 5; 6, 7, the carrier 3 is movable from the unloaded starting position shown for example in FIGS. 2, 3, 19 and 22, counter to the restoring force of at least one elastic restoring element, to a balancing position in which the carrier is brought closer to the sports item 1 and which is shown in FIGS. 4, 5, 12, 13 and 20, in which balancing position the carrier 3 is brought closer to the sports item 1.

Each distributing device 2 has at least one restoring element, which restoring element is designed as an elastically deformable spring element or damping element. These elastically deformable spring elements are held at one end on the carrier 3 and at the other end on the sports item 1. These spring elements or damping elements can be arranged or braced between the carrier 3 and the sports item 1 in such a way that a stable and secure connection between the carrier 3 and the sports item 1 is ensured even when each of the distributing devices 2 has only in each case one or two pivoting arms 4, 5; 6, 7. However, such a spring element or damping element also has at the same time a sufficient inherent elasticity to ensure that the impacts and vibrations acting on the ski are transmitted only in attenuated form to the carrier 3 and to the user held on the carrier 3. This at any rate only attenuated transmission of impacts and vibrations is felt by the user to provide substantially improved skiing comfort.

While the spring elements or damping elements of the distributing device shown in FIGS. 18 to 22 are designed as elastically deformable tubes 32; 33, the spring elements or damping elements of the distributing device shown in FIGS. 1 to 17 are designed as a resiliently flexible spring plate 12; 13.

Each of the resiliently flexible spring plates 12; 13 of the distributing devices 2 shown in FIGS. 1 to 17 can be produced from any suitable resiliently elastic material. Thus, the spring plates 12; 13 can also be produced, for example, from carbon material. However, in the embodiment shown here, the spring plate 12; 13 is designed as a spring steel plate.

To design the at least one spring plate 12; 13 on the one hand with sufficient stiffness and stability and on the other hand with satisfactory spring elasticity, the spring plates 12; 13 can have an edge-side indentation or protrusion and in addition, or in this case instead, at least one plate opening 14, which plate opening of the spring plate 12; 13 affords a defined flexibility. In the embodiments of the sports item 1 shown here, the flexibility of the at least one spring plate 12; 13 is such that the distance of the carrier 3 from the sports item 1 decreases when taking a curve.

To ensure that the distributing device 2 provided between the carrier 3 and the sports item 1 can be bound securely and fixedly to the sports item 1, the distributing devices 2 shown in FIGS. 1 to 22 have at least one holder 15 held on the sports item 1, which holder 15 is connected to the at least one pivoting arm 4, 5 via the at least one joint 8, 9.

In the distributing devices 2 shown in FIGS. 1 to 17, at least one holding slit 30, 31 is provided on the carrier 3 and on the at least one holder 15. To be able to accommodate and fix the resiliently flexible spring plate 12; 13 between the carrier 3 and the at least one holder 15, the at least one spring plate 12; 13 is inserted with its adjacent plate edge into the holding slits 30, 31. To ensure that the spring elasticity of the at least one spring plate 12; 13 can be utilized over as large a partial area as possible of its longitudinal extent, the at least one slit 30 provided on the carrier 3 widens from the slit base in the direction of the slit opening. It will be seen from FIG. 9 that the at least one holding slit 30, 31 provided on the carrier 3 and/or on the holder 15 is, with the exception of the slit base, open on three sides.

The distributing devices 2 shown in FIGS. 1 to 22 have in this case at least two pivoting arms 4, 5; 6, 7, which are arranged in parallel pairs, are oriented in the longitudinal direction of the sports item 1, and in particular are laterally spaced apart from each other. Since the pivoting arms 4, 5 and 6, 7 are each arranged on both sides of the at least one spring element or damping element, these pivoting arms 4, 5 on the one hand and 6, 7 on the other hand can ensure that the spring elements or damping elements arranged between them, for example the carrier plates 12; 13 held in the holding slits 30, 31, are secured on the carrier 3 and on the holders 15.

The pivoting arms 4, 5; 6, 7 are each mounted pivotably, on both sides and laterally, on the carrier 3 and on the associated holder 15 via a pivot axle serving as joint 8, 9; 10, 11. The pivot axle of at least one of the joints 8, 9; 10, 11 of the joint arrangement can be varied in position in such a way that the distance between the one long side of the carrier 3 and the sports item 1 can be made smaller or larger compared to the distance from the other long side of the carrier 3.

The distributing devices 2 of the sports item shown in the figures can each be assigned a respective spacer 27, 27'. Such a spacer 27, 27' can fix the minimum distance of the carrier 3 from the sports item and is preferably designed such that, at a minimum distance of the carrier 3 from the sports item 1, the distance between the one long side of the carrier 3 and the sports item 1 can be made smaller or larger compared to the distance from the other long side of the carrier 3.

The embodiments of the sports item 1 shown in FIGS. 1 to 22 are distinguished by having substantially improved directional stability in steep positions and in particular at tight curves. It is desired to be able to increase the distance 3 on its long side located on the inside of the curve and, in addition or instead, to be able to reduce it on its long side located on the outside of the curve.

Figures 12, 13, 14, 15, 16:
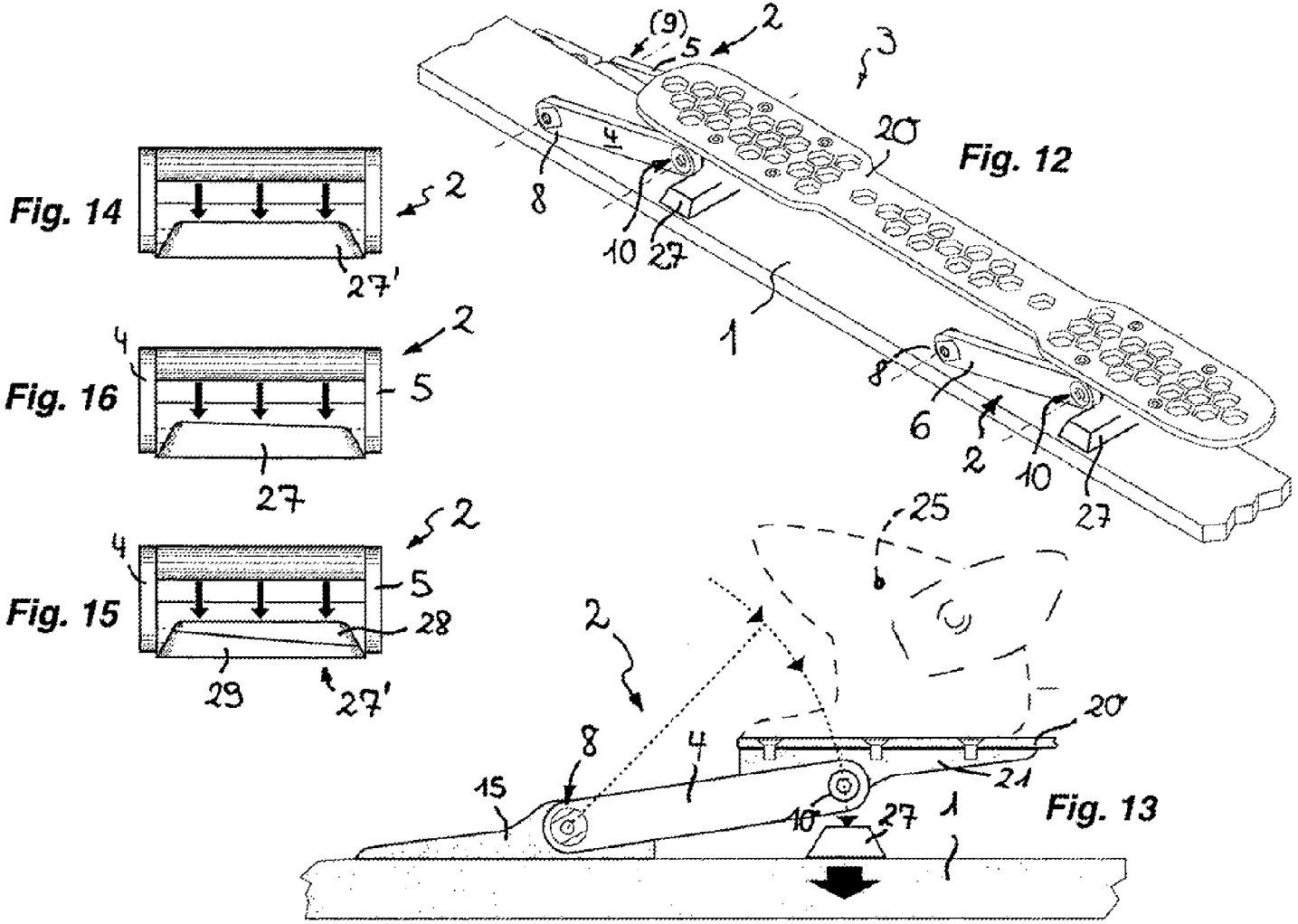
FIG. 12 shows a perspective side view of a sports item designed here as a ski, specifically in the area of its two distributing devices, wherein each of the distributing devices connecting the carrier to the sports item is assigned a rod-shaped or slat-shaped spacer.
FIG. 13 shows the sports item from FIG. 12 in a side view in the area of one of the distributing devices.
FIG. 14 shows the distributing device held on the sports item by a holder, in the area of the spacer of the distributing device.
FIG. 15 shows the distributing device and the spacer from FIG. 14, likewise in a front view.
FIG. 16 shows the distributing device, depicted likewise in a front view and secured on the sports item by the holder, which distributing device in this case has a spacer which has different heights in the area of the one long side of the sports item compared to the other side of the sports item, in such a way that, at the minimum distance of the carrier from the sports item, and with this spacer actuated, the distance between the one long side of the carrier and the sports item is made smaller or larger compared to the distance from the other long side of the carrier.

In the illustrative embodiment shown in FIGS. 12 to 16, the pivoting arms 4, 5; 6, 7, in the area of their joint 10, 11 directed toward the carrier 3, act on the spacer 27, 27' when the carrier 3 adopts the fixed minimum distance from the sports item 1. The spacer 27, 27' here has a rod-shaped or slat-shaped design and is oriented transversely with respect to the longitudinal extent of the sports item 1. It will be seen from the illustrative embodiments shown in FIGS. 14 to 16 that the spacer 27, 27' can be produced from any suitable material, if appropriate also from metal. However, in order to achieve the smoothest possible transition of the ski behavior adapting to changes in the specific skiing situation, spacers 27, 27' are preferred which are produced from elastic material. From a comparison of FIGS. 14 and 15, it is clear that the spacer 27' shown there has a different elasticity in different partial areas 28, 29 of its longitudinal extent, in such a way that, at the minimum distance of the carrier 3 from the sports item 1, the distance between the one long side of the carrier 3 and the sports item 1 is made smaller or larger compared to the distance from the other long side of the carrier 3. By contrast, a different embodiment 27 of the spacer is shown in FIG. 16. The spacer 27 shown in FIG. 16 has different heights in the area of the one long side of the sports item 1 compared to the other long side of the sports item 1, in such a way that, at the minimum distance of the carrier 3 from the sports item 1, the distance between the one long side of the carrier 3 and the sports item 1 is likewise made smaller or larger compared to the distance from the other long side of the carrier 3.

If the joints 8, 9; 10, 11 permit sufficient play of the carrier 3 relative to the sports item 1, particularly in the transverse direction of the sports item 1, the spacers 27, 27' are sufficient for improving the skiing action of the sports item 1 in steep positions or in tight curves. However, the embodiment shown here is preferred in which, in addition to the spacers 27, 27', the pivot axle of the at least one of the joints 8, 9; 10, 11 of the joint arrangement of each distributing device 2 can be varied in position in such a way that the distance between the one long side of the carrier 3 and the sports item 3 can be made smaller or larger compared to the distance from the other long side of the carrier 3.

To be able to bring about such a change of position of the pivot axle on at least one of the joints 8, 9; 10, 11, the pivot axle of at least one of the joints 8, 9; 10, 11 of the joint arrangement can be changed in position by an eccentric. In the exploded perspective view in FIG. 9, it will be seen particularly clearly that the pivoting arms 4, 5; 6, 7 arranged on both sides of each holder 15 (with the holder 15 for this purpose above a common plug-in axle 16) are guided rotatably in at least one of the two guide openings of each holder 15 with an eccentrically arranged axle segment 17 designed as an eccentric. It will be clearly seen from FIGS. 1 to 10 that the pivoting arm 4, 6 adjacent to the at least one eccentric axle segment 17 is connected to the plug-in axle 16 for conjoint rotation.

An embodiment not shown here can also have a plug-in axle 16 which is arranged in each case with an eccentric axle segment 17 in the guide openings of the holders 15. The eccentricities of these two axle segments 17 arranged on such a plug-in axle 16 can be adapted to each other such that the distance between the one long side of the carrier 3 and the sports item 1 is made smaller or larger compared to the distance of the other long side of the carrier 3, for example as a result of an inclined position of the sports item when taking a curve.

As a result of the eccentricity of the eccentric axle segments serving as the pivot axle of the pivoting arms 4, it is possible to ensure that the sports item 1, for example in tight curves, has an increased angle position with respect to the carrier 3 carrying the user, which position additionally makes it easier to take such a tight curve. The contact pressure acting on the sports item 1, for example in tight curves, causes a spring deflection of the distributing devices 2 held on the sports item 1, independently of the curve radius, and an edging of the carrier 3 relative to the sports item 1.

Figure 10:
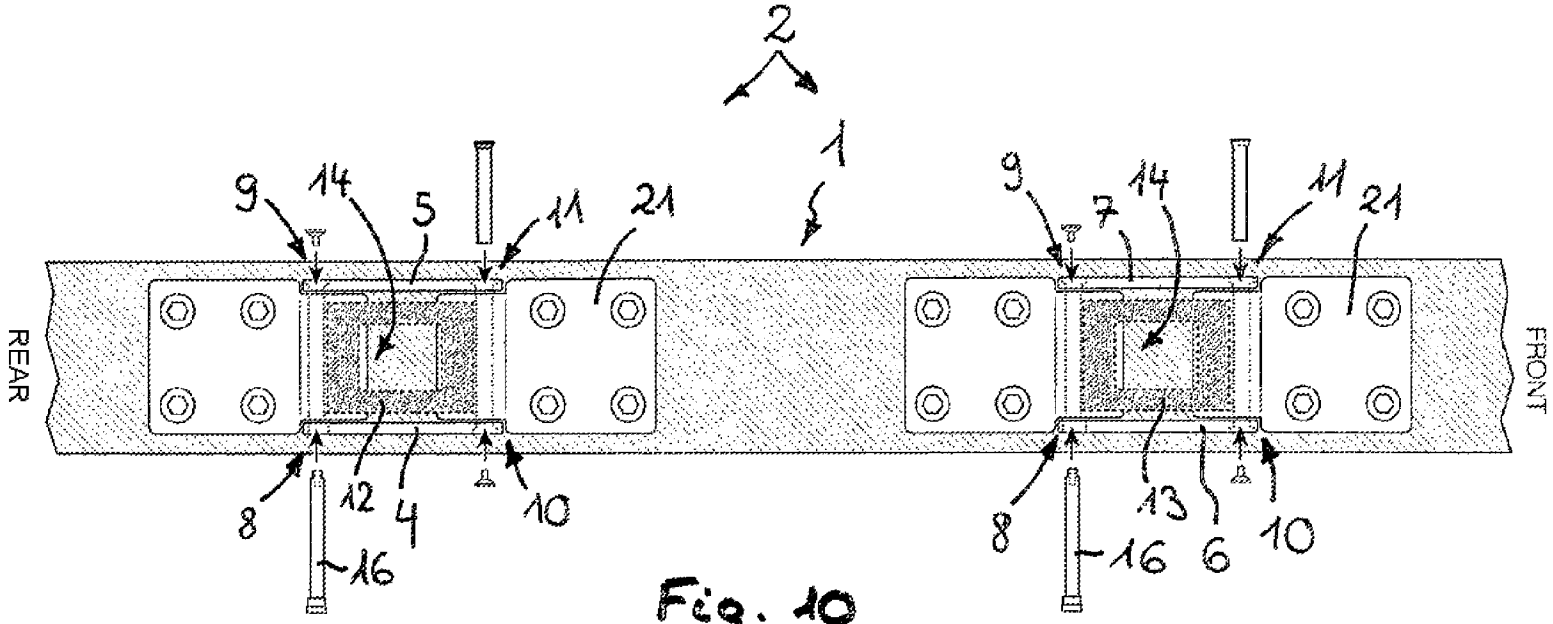
FIG. 10 shows a plan view of a ski whose distributing device, intended to support the carrier carrying the coupling device, has two pairs of parallel pivoting arms spaced apart from each other in the longitudinal direction of the sports item.
Figure 11:
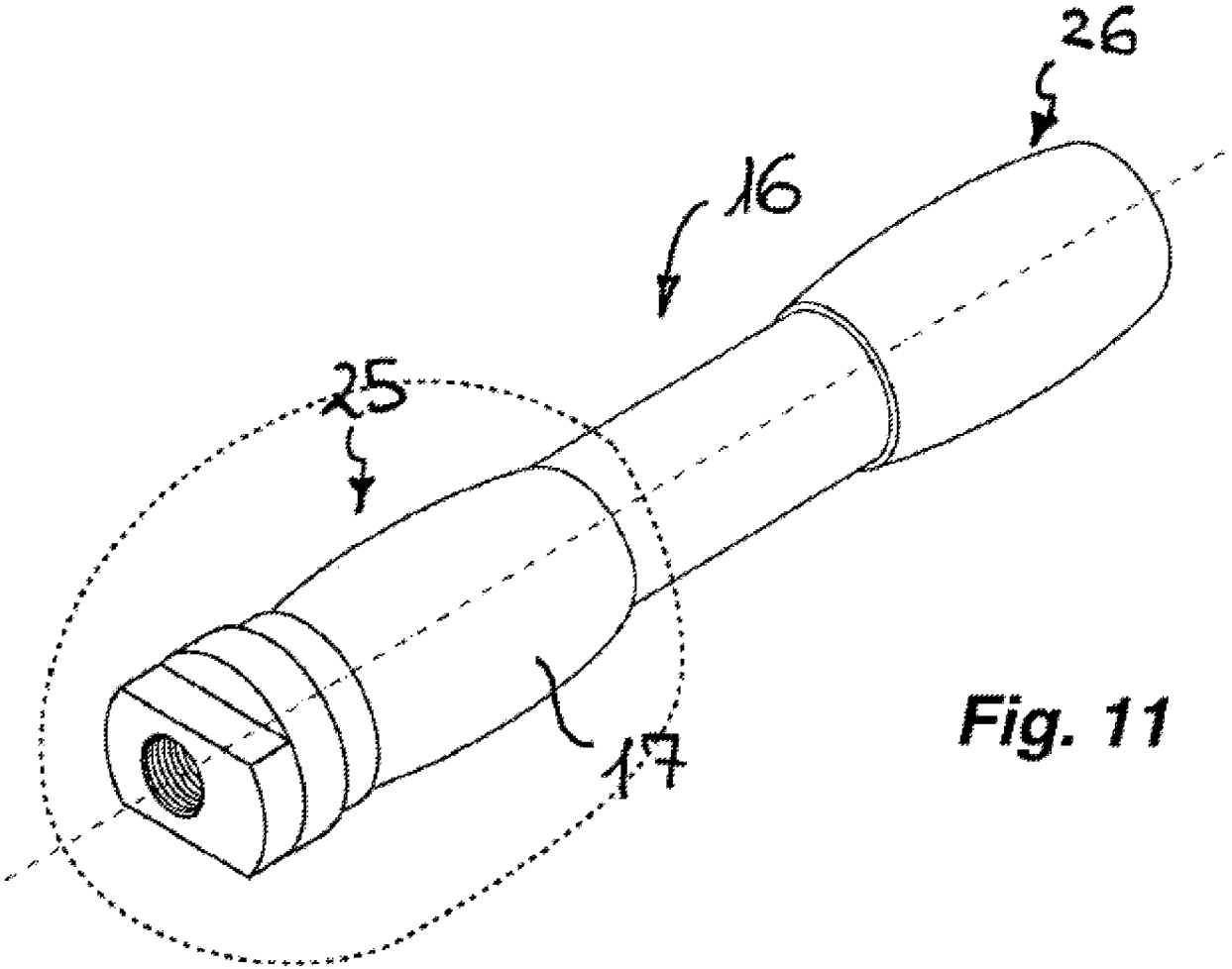
FIG. 11 shows a plug-in axle which is comparable to the plug-in axle according to FIG. 6 and in which the bearing points spaced apart from each other in the longitudinal direction of the plug-in axle are designed as spherically shaped cross-sectional thickenings.

FIGS. 10 and 12 show a preferred embodiment of the sports item 1 according to the invention, in which in each case two distributing devices 2 spaced apart from each other in the longitudinal direction of the sports item are provided with parallel pivoting arms 4, 5; 6, 7. The pivoting arm pairs of the distributing devices 2 are in this case each held, by a holder 15, at a distance from each other on the sports item 1 or on the holder 15. These pivoting arm pairs 4, 5; 6, 7 ensure that the carrier 3, upon spring deflection of the distributing devices 2, can come closer to the holders 15 in an almost unchanged parallel setting with respect to the longitudinal direction of the sports item 1. The carrier 3 here has a carrier plate 20 which, on its underside, has a carrier holder 21 for each of the pivoting arm pairs 4, 5; 6, 7. The holding slits 30 for the spring plates 12, 13 are provided on the carrier holders 21 of the carrier 3. FIG. 2 shows the sports item 1 in a starting position, in which no centrifugal forces act on the distributing device 2 of the sports item. This starting position also corresponds, for example, to a straight line of travel of the user with the aid of the sports item 1. In this case, the carrier 3 carrying the user is held in a neutral position with the aid of the spring plate 12; 13. In this neutral position, the eccentric provided here on one side and shown in more detail in FIG. 3 is not yet active. When taking a curve, centrifugal forces act on the distributing device 2 of the sports item 1 and press the carrier 3 in the direction of the sports item 1. The spring plate 12; 13 is thereby tensioned. The spring plate 12; 13 is also acted on and tensioned by the forces acting transversely with respect to the sports item. The position of the pivot axle of at least one of the pivoting arms is thus changed in such a way that the distance of the carrier from the sports item 1 on the carrier long side located on the inside of the curve is increased by comparison with the carrier longitudinal axis on the outside of the curve. As a result of this increased angle position of the carrier 3 on one side relative to the sports item 1, which position is further promoted by the spacers 27, 27', the directional stability of the sports item 1 is also increased when taking tight curves. This increased angle position of the carrier 3 relative to the sports item 1, which position is indicated on the right-hand side of FIG. 4, has the effect that the initiated curve can be taken with less force being applied and can also be exited likewise. FIG. 5 indicates that the increased distance of the carrier 3 from the sports item 1, for example on one side when taking a curve, can also be relatively small, while still being noticeable to the user through an appreciable improvement of the skiing properties. In FIGS. 9 and 11, the plug-in axle 16 can be seen in different embodiments with its eccentrically arranged axle segment 17 here provided on one side. For reasons of clarity, the spring plate 12; 13 also required has not been shown. The inner face of the sports item 1 is here located on the side directed toward the observer. From a comparison of FIGS. 3 and 5, it is clear that, upon an inward deflection of the carrier 3 and a pivoting movement of the pivoting arm oriented in the direction of the sports item 1, the eccentric formed by the axle segment 17 moves continuously downward. Even with a slight axle rotation of the plug-in axle 17, which takes place as a result of the centrifugal forces that act for example when taking a curve, the distance between the carrier 3 and the sports item 1 increases, as a result of which an increased angle position is adopted. It is a particular advantage of the distributing devices 2 arranged on the sports item 1 that they can also compensate for or attenuate uncomfortable vibrations, for example when skiing across uneven or ice-covered pistes.

Figure 17:
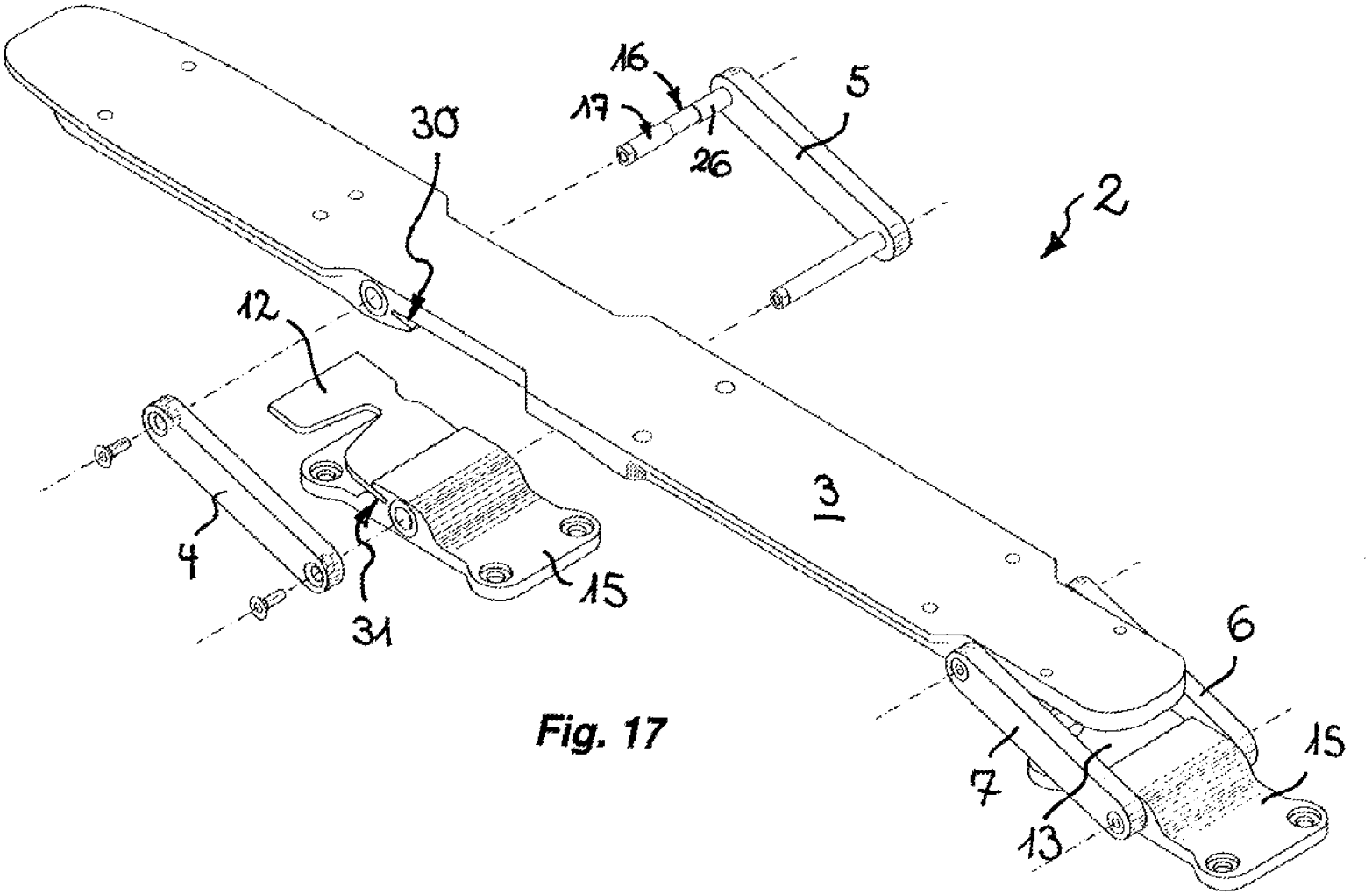
FIG. 17 shows the distributing device intended for a ski, in an embodiment which has been modified in relation to FIGS. 1 and 9 and in which the pivot axles of the pivoting arms assigned to each other and secured at one end on the holder and at the other end on the carrier are firmly connected to one of these pivoting arms, while they engage with their free axle end in corresponding bearing openings on the opposite pivoting arm.
Figure 18:
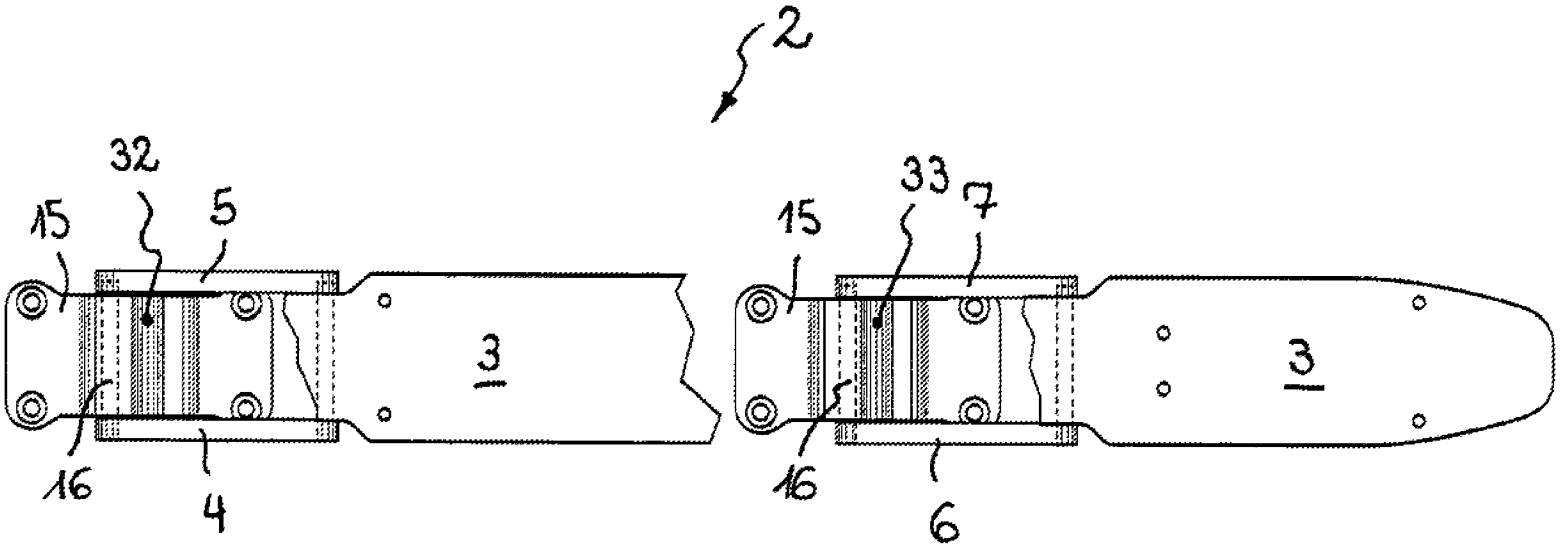
FIG. 18 shows a plan view of the distributing device which is likewise provided for a ski and which, instead of the spring plates provided in FIGS. 1 to 17 and serving as restoring elements, here has elastically deformable tubes as spring element or damping element.

Whereas, in the carrier 3 shown in FIGS. 1 to 16, the carrier plate 20, on the one hand, and the carrier holders 21 having the holding slits 30 for the spring plates 12, 13, on the other hand, form components that are produced separately from each other, the holding slits 30 for the spring plates 12, 13 in the carrier 3 shown in FIG. 17 are incorporated directly into the flat face of the carrier 3 directed toward the sports item. Moreover, from the perspective detailed view in FIG. 17, it will be clear that the plug-in axles 16 are connected to one of the pivoting arms 4, 5 assigned to each other in pairs so as to form a fork-shaped component, wherein the free axle ends of the plug-in axles 16 held on the pivoting arm 5 can be inserted into and fixed in corresponding axle openings or bearing openings on the assigned and adjacent pivoting arm 4.

The distributing device 2 shown in FIGS. 18 to 22 has spring elements or damping elements which are here each designed as an elastically deformable tube 32, 33 oriented transversely with respect to the longitudinal extent of the ski 1. From a comparison of FIGS. 21 and 22, for example, it will be clear that the tubes serving as spring elements or damping elements and forming part of the distributing device shown in FIGS. 18 to 22 are held, via connection seams 34, 35 arranged on opposite tube sides, between the carrier 3 of the distributing device 2, on the one hand, and between the sports item 1 and in particular the holder 15 mounted on the sports item 1, on the other hand.

Figure 19:
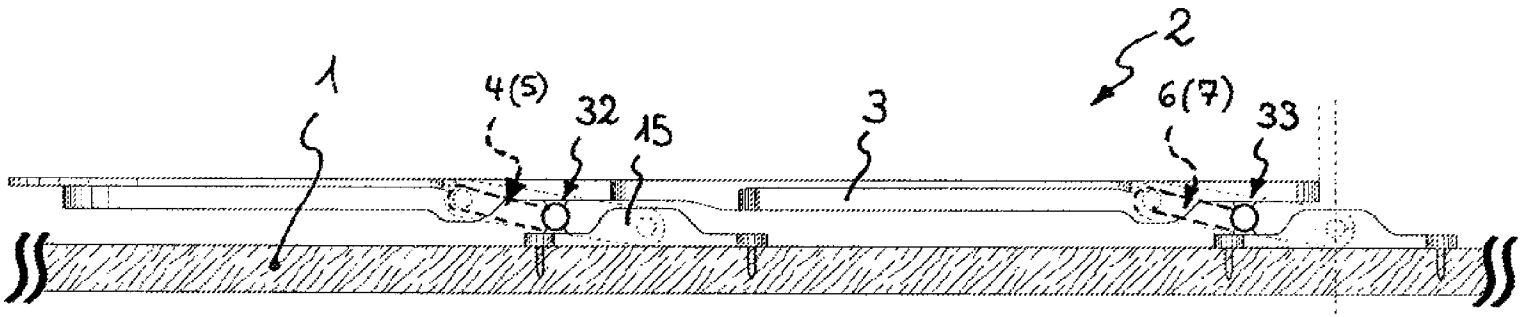
FIG. 19 shows a side view of the distributing device from FIG. 18 in an unloaded state.
Figure 20:
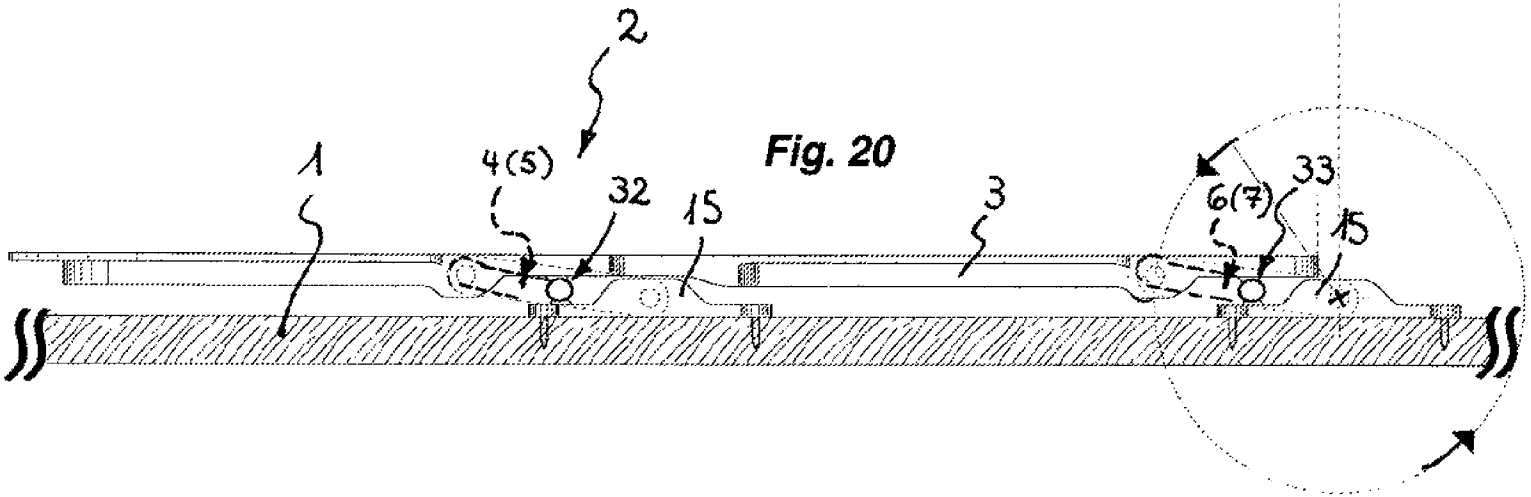
FIG. 20 shows a side view of the distributing device from FIGS. 18 and 19 in a loaded damping position.
Figure 21:
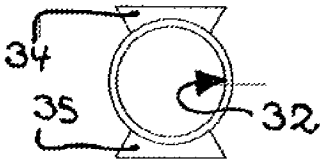
FIG. 21 shows one of the spring elements or damping elements of the distributing device shown in FIGS. 18 to 20, said element being depicted in a cross section and being designed as an elastically deformable tube.
Figure 22:
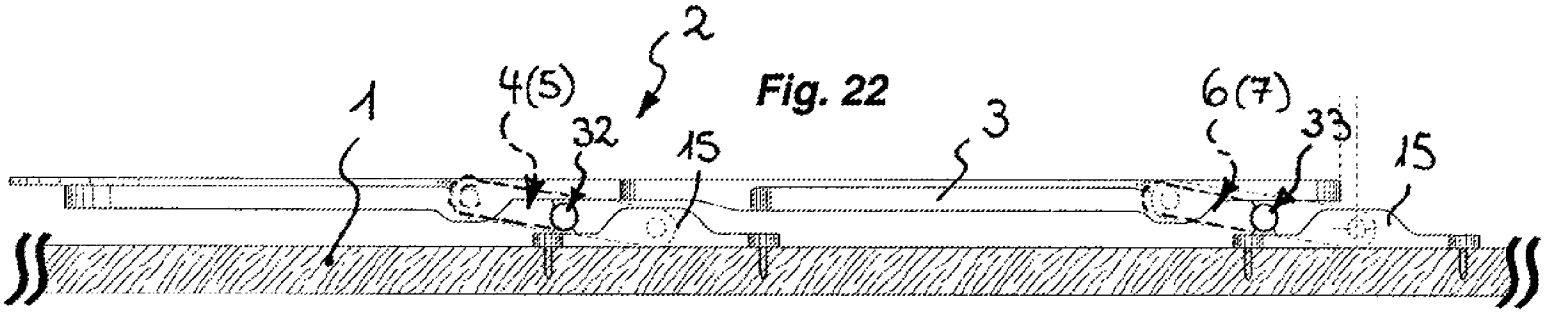
FIG. 22 shows the distributing device from FIGS. 18 to 21, likewise in an unloaded state.

While the tubes 32, 33 serving as spring elements or damping elements have an at least almost circular cross section in the unloaded state shown in FIGS. 19 and 22, these tubes 32, 33 deform elliptically in the loaded state, i.e. the compressed state, according to FIG. 20. When vertical pressure is applied to the carrier 3, the latter moves slightly downward and rearward, counter to the direction of travel, according to the circle of rotation D shown in FIG. 20, such that the tube sections 32, 33 located between carrier 3 and sports item 1 are deformed elliptically. As a result of a corresponding eccentricity of at least one of the pivot axles of the pivoting arms 4, 5; 6, 7 and/or as a result of at least one spacer inclined transversely with respect to the longitudinal axis of the ski, the pivot axle of at least one joint 8, 9; 10, 11 of the joint arrangement in the distributing device 2 shown in FIGS. 18 to 22 is likewise variable in terms of its position, in such a way that the distance between the one long side of the carrier 3 and the sports item 1 can be made smaller or larger compared to the distance from the other long side of the carrier 3. In this way, it is also possible, in the distributing device 2 shown in FIGS. 18 to 22, to achieve the already above-described advantages in terms of damping properties and directional stability of the sports item 1 equipped with such a distributing device.

From a comparison of FIGS. 6 and 11, it will be seen that the plug-in axles 16 are mounted in the holder 15 by way of two axle segments 17, 26 spaced apart from each other in the longitudinal direction of the plug-in axle 16. To promote tilting of the carrier 3 relative to the sports item 1, and at the same time to facilitate the pivoting movement of the pivoting arms 4, 5; 6, 7, provision is made, in the embodiment of the plug-in axle 16 shown in FIG. 12, that this plug-in axle 16 has a spherically shaped cross-sectional thickening in the area of each of the axle segments 17, 26 serving as bearing points. These spherically shaped cross-sectional thickenings on the axle segments 17, 26 of the plug-in axle 16 shown in FIG. 12 act in practice like a ball joint.

The sports item 1 can be designed as a sliding body and, for example, as a roller carrier or, as in the present case, as a ski.

LIST OF REFERENCE SIGNS

1 sports item
2 distributing device
3 carrier
4 pivoting arm
5 pivoting arm
6 pivoting arm
7 pivoting arm
8 joint
9 joint
10 joint
11 joint
12 spring plate
13 spring plate
14 plate opening
15 holder
16 plug-in axle
17 (eccentric) axle segment
18 guide opening
19 guide opening
20 carrier plate
21 carrier holder
25 coupling device
26 (non-eccentric) axle segment
27 spacer
27' spacer
28 partial area
29 partial area
30 holding slit
31 holding slit
32 tube
33 tube
34 connecting seam
35 connecting seam

The invention claimed is:

1. A sports item (1), comprising a carrier (3) for a coupling device (25) for accommodating a user and comprising at least one distributing device (2) for at least one of loads or forces to be transmitted to the sports item (1), said at least one distributing device (2) connects the carrier (3) to the sports item (1) via a joint arrangement having at least two pivoting arms (4, 5; 6, 7), which are oriented in a longitudinal direction of the sports item (1) and are spaced laterally apart from each other, the pivoting arms (4, 5; 6, 7) are pivotably mounted on both sides, in each case via a pivot axle serving as a joint (8, 9; 10, 11), with one arm end mounted on a holder (15) held on the sports item (1) and with another arm end mounted on the carrier (3), the carrier (3) is movable from a starting position, counter to a restoring force of at least one elastic restoring element, to a balancing position in which the carrier is brought closer to the sports item (1), said at least one restoring element is an elastically deformable spring element or damping element (12; 13) which is held at a first end on the carrier (3) and at a second end on the sports item (1), and the pivoting arms (4, 5; 6, 7) arranged on both sides of the holder (15) and on the carrier (3) are connected to the holder (15) and on the carrier (3) via a common plug-in axle, and the pivot axle of at least one of the joints (8, 9; 10, 11) of the joint arrangement is varied in position by an eccentric.

2. The sports item as claimed in claim 1, wherein the at least one spring element or damping element is an elastically deformable tube (32, 33).

3. The sports item as claimed in claim 2, wherein the at least one tube serving as the spring element is oriented with a tube longitudinal axis transverse to the longitudinal extent of the sports item (1).

4. The sports item as claimed in claim 1, wherein the at least one spring element is a resiliently flexible spring plate (12; 13).

5. The sports item as claimed in claim 4, wherein the spring plate (12; 13) has a flexibility defined by at least one of an edge-side indentation or protrusion or at least one plate opening (14).

6. The sports item as claimed in claim 1, wherein the distributing device (2) has at least one holder (15) held on the sports item (1), said holder (15) is connected to the at least one pivoting arm (4, 5) via the at least one joint (8, 9).

7. The sports item as claimed in claim 6, wherein the at least one spring element is a resiliently flexible spring plate, on the carrier (3) and on the holder (15) of the at least one distributing device (2), at least one respective holding slit (30, 31) is provided, and the at least one spring plate (12; 13) is inserted with an adjacent plate edge into at least one of said respective holding slits (30, 31).

8. The sports item as claimed in claim 7, wherein the at least one holding slit (30) provided on the carrier (3) widens from a slit base in a direction of the slit opening.

9. The sports item as claimed in claim 7, wherein the at least one holding slit (30, 31) provided on the carrier (3) or on the holder (15) is, with the exception of the slit base, open on three sides.

10. The sports item as claimed in claim 1, wherein the pivoting arms (4, 5; 6, 7) are arranged on both sides of the at least one spring element.

11. The sports item as claimed in claim 1, wherein at least one tube (32, 33) is provided as the spring element and is held at one end on the holder (15) and at the other end on the carrier (3).

12. The sports item as claimed in claim 1, wherein the pivoting arms (4, 5; 6, 7) arranged on both sides of the at least one spring element secure the at least one spring element, on the carrier (3) and on the holder (15).

13. The sports item as claimed in claim 1, wherein the pivot axle of at least one of the joints (8, 9; 10, 11) of the joint arrangement is variable in position in such a way that a distance between the one long side of the carrier (3) and the sports item (1) is made smaller or larger compared to a distance from another long side of the carrier (3).

14. The sports item as claimed in claim 1, wherein the plug-in axle (16) passes through two spaced-apart guide openings (18, 19) in which the plug-in axle (16) is held rotatably, and the plug-in axle (16) is guided rotatably in at least one of the two guide openings (18, 19) with an eccentrically arranged axle segment (17) designed as the eccentric.

15. The sports item as claimed in claim 1, wherein at least the pivoting arm (4, 5; 6, 7) adjacent to the eccentric is connected to the plug-in axle (16) for conjoint rotation therewith.

16. The sports item as claimed in claim 1, wherein there are multiple ones of the eccentric, and of the joints (8, 9) mounted rotatably on the holder (15), the pivot axle of at least two of the joints (8, 9) arranged on opposite sides of the holder (15) is varied in position in each case by one of the eccentrics.

17. The sports item as claimed in claim 1, wherein the plug-in axle (16) is held exchangeably on the holder (15) assigned to it.

18. The sports item as claimed in claim 1, wherein the at least one distributing device (2) of the sports item (1) is assigned a spacer (27, 27') which sets a minimum distance of the carrier (3) from the sports item (1), and the at least one spacer (27, 27') is designed such that, at the minimum distance of the carrier (3) from the sports item (1), a distance between one long side of the carrier (3) and the sports item (1) is made smaller or larger compared to a distance from another long side of the carrier (3).

19. The sports item as claimed in claim 18, wherein at least one of the carrier (3) or the pivoting arms (4, 5; 6, 7) act on the spacer (27, 27') at the minimum distance of the carrier (3) from the sports item (1).

20. The sports item as claimed in claim 19, wherein the spacer (27, 27') has a rod-shaped or slat-shaped design and is oriented transversely with respect to the longitudinal extent of the sports item (1).

21. The sports item as claimed in claim 20, wherein the spacer (27, 27') is produced from elastic material.

22. The sports item as claimed in claim 21, wherein the spacer (27, 27') has a different elasticity in different partial areas (28, 29) of its longitudinal extent, in such a way that, at the minimum distance of the carrier (3) from the sports item (1), the distance between the one long side of the carrier (3) and the sports item (1) is made smaller or larger compared to the distance from the other long side of the carrier (3).

23. The sports item as claimed in claim 22, wherein there is a plurality of the spacers (27, 27') that have different heights in an area of the one long side of the sports item (1) compared to the other long side of the sports item (1), in such a way that, at the minimum distance of the carrier (3) from the sports item (1), the distance between the one long side of the carrier (3) and the sports item (1) is made smaller or larger compared to the distance from the other long side of the carrier (3).

24. The sports item as claimed in claim 18, wherein the at least one spacer (27, 27') has an abutment face inclined with respect to a plane lying in the running surface of the sports item (1).

25. The sports item as claimed in claim 1, wherein the deformability of the at least one spring element is such that a distance of the carrier from the sports item (1) decreases when taking a curve.

26. The sports item as claimed in claim 1, wherein axle segments (17, 26) of the plug-in axle (16) that are mounted rotatably in guide openings (18, 19) of holder (15) or the carrier holder (21) are comprised of a spherical cross-sectional thickening of the plug-in axle (16).

27. The sports item as claimed in claim 1, wherein the sports item (1) is a sliding body.

* * * * *